US005896698A

United States Patent [19]

Nurse

[11] Patent Number: 5,896,698

[45] Date of Patent: Apr. 27, 1999

[54] DECORATIVE COVER FOR A PLANT CONTAINER

[76] Inventor: Angela Nurse, 7408 Tree Mountain Pkwy., Stone Mountain, Ga. 30083

[21] Appl. No.: 08/908,244

[22] Filed: Aug. 7, 1997

[51] Int. Cl.[6] ..... A01G 13/00

[52] U.S. Cl. ..... 47/28.1; 47/26

[58] Field of Search ..... 47/28.1, 41.01, 47/72, 79, 26; 62/457, 372

[56] References Cited

U.S. PATENT DOCUMENTS

| | | | |
|---|---|---|---|
| 2,209,778 | 7/1940 | Krasowski | 47/72 |
| 2,302,259 | 11/1942 | Rothfuss | 47/72 |
| 2,482,322 | 9/1949 | Cortese | 215/12 |
| 4,265,049 | 5/1981 | Gorewitz | 47/28.1 X |
| 4,871,597 | 10/1989 | Hobson | 215/12.1 X |

*Primary Examiner*—Thomas B. Will
*Assistant Examiner*—Robert Pezzuto
*Attorney, Agent, or Firm*—John L. James

[57] ABSTRACT

A decorative cover for a plant container is constructed from a rectangular piece of stretchy fabric formed into a tube that slips over the container. The top and bottom ends of the tube are fitted with elastic members to control the size of the open ends of the tube and to ensure a snug, wrinkle free fit. For tapered containers the bottom end of the tube is drawn smaller that the top end of the tube to better fit the contour of the container. A slit along the sidewall and top of the tube opens the tube for easier insertion of the container. An invisible zipper closes the slit and a hook and eye fastener securely fastens the slit.

20 Claims, 1 Drawing Sheet

DECORATIVE COVER FOR A PLANT CONTAINER

FIELD OF THE INVENTION

The present invention relates generally to plant containers, and more particularly, to a cover for a plant container to compliment a decor.

BACKGROUND OF THE INVENTION

Plants are used in homes and offices for improving air quality and for their aesthetic appeal. Containers for plants are no longer limited to red clay pots but come in a variety of materials, shapes and sizes. Some containers are decorative having designs thereon, or are fitted with custom made fabric covers. While custom made fabric covers are desired for their ability to match or compliment a decor in color, style and texture, they are expensive so that their use is limited. Accordingly, it will be appreciated that it would be highly desirable to have a plant container cover that would match or compliment a decor in color, style and texture that is relatively inexpensive.

SUMMARY OF THE INVENTION

The present invention is directed to overcoming one or more of the problems set forth above. Briefly summarized, according to the present invention, a decorative cover is provided for a plant container. The container has a base with a sidewall extending upward from the base forming a top edge portion defining a plant receiving opening. The cover comprises a fabric formed into an open tube for fitting about the container. The tube has a bottom edge portion defining a bottom opening, a top edge portion defining a top opening and a sidewall extending between the top and bottom edge portions, with the top opening being concentric with the plant receiving opening of the container. A top hem is formed along the top edge portion about the top opening and a bottom hem is formed along the bottom edge portion about the bottom opening. A first elastic means is associated with the top hem for contractibly expanding the top opening with the top opening expanding to receive the container then retracting to fit the tube sidewall along the container sidewall. A second elastic means is associated with the bottom hem for contractibly expanding the bottom opening with the bottom opening being expandable to receive the container and then retracting to fit the tube sidewall along the container sidewall.

The cover is formed of a piece of stretchy material to conform to the shape of the container and to stretch to allow fitting about the container. The tubular structure is drawn smaller at its bottom than at its top to better fit the contour of tapered containers. A slit along the sidewall and top edge portion of the tube receive a zipper and hook and eye fastener which make applying the cover easier.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
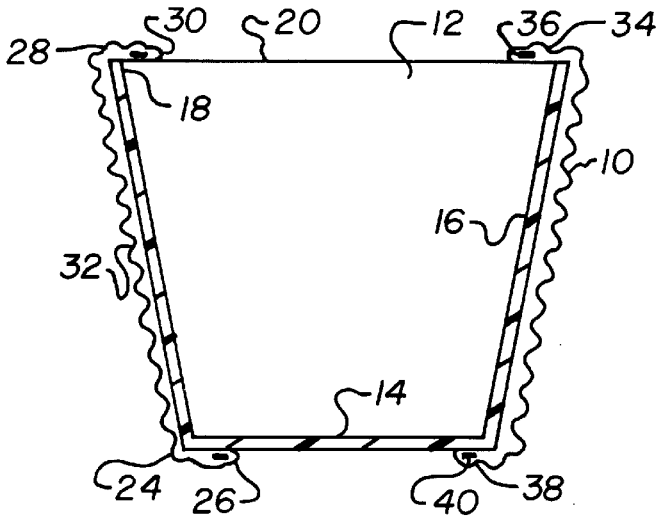
FIG. 1 is a sectional view of a preferred embodiment of a decorative cover installed on a plant container according to the present invention.
Figure 2:
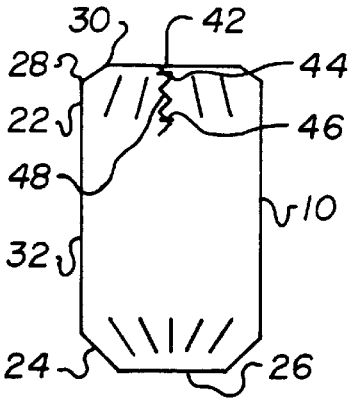
FIG. 2 is a diagrammatic plan view of the cover of FIG. 1 showing tubular construction with a zipper.
Figure 3:
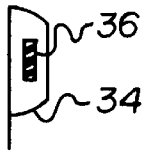
FIG. 3 is a diagrammatic sectional view illustrating the hem and elastic member for closing-in the ends of the tube.
Figure 4:
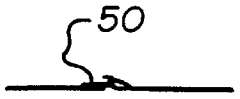
FIG. 4 is a diagrammatic top view illustrating a hook and loop fastener for closing the top hem of the tube.
Figure 5:
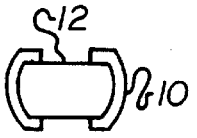
FIG. 5 is a diagrammatic sectional view, similar to FIG. 1, but illustrating a container with bulging sidewalls.

Referring to FIGS. 1–4, a decorative cover 10 for a plant container 12 covers the container 12 to blend it with the room decor. The container 12 has a base 14 with a sidewall 16 extending upward from the base 14 forming a top edge portion 18 defining a plant receiving opening 20. Sidewall 16 may be vertically straight, taper in from the top edge portion 18 toward the base 14 or may be bowed or curved (FIG. 5). Container 12 may be constructed of wood, metal plastic or other nonporous material. Clay pots and other porous containers may be used with a liner to prevent moisture from damaging the cover.

The cover 10 is preferably a rectangular piece of stretchy fabric formed into an open tube 22 for fitting about the container 12. Preferably, the fabric exhibits four way stretch to stretch in both lateral directs and both transverse directions, or, as viewed in FIG. 2, up, down, left and right. The fabric may be constructed of stretch yarn or may be weaved in a stretch pattern. The tube 22 has a bottom edge portion 24 defining a bottom opening 26, a top edge portion 28 defining a top opening 30, and a sidewall 32 extending between the top and bottom edge portions 28, 24. When the cover 10 is installed on the container 12, the top opening 30 is concentric with the plant receiving opening 20 of the container 12. Preferably, the top opening 30 is the same dimension as the plant receiving opening 20 of the container 12 so that the fabric does not extend over the plant receiving opening 20 where it could become wet when the plant is watered.

A top hem 34 is formed along the top edge portion 18 about the top opening 30. Means, such as elastic member 36, are associated with the top hem 34 for contractibly expanding the top opening 30 so that top opening 30 expands to receive container 12 then retracts to fit the tube sidewall 32 along the container sidewall 16. Similarly, a bottom hem 38 is formed along the bottom edge portion 24 about the bottom opening 26. Means, such as elastic member 40, are associated with the bottom hem 38 for contractibly expanding the bottom opening 26 so that bottom opening 26 expands to receive the container 12 and then retracts to fit the tube sidewall 32 along the container sidewall 16. Elastic member 40 is shorter than elastic member 36 to draw the bottom opening smaller that the top opening so that the cover is more easily fitted about a tapered container.

The hems 34, 38 are movable relative to their respective enclosed elastic members 36, 40 so that the fabric may be moved about to smooth it and help it assume the shape of the container. The elastic members are preferably free of attachment to the fabric so that the fabric is freely movable to eliminate wrinkles, folds and creases; however, the top elastic member 36 may be attached to top hem 34 when the tube is one that opens up for easier installation. A tube that opens up is one wherein the top hem contains a slit 42 adjacent left and right hem end portions and wherein the top elastic member 34 has a left end attached to the left hem end portion and a right end attached to the right hem end portion. By this construction, the fabric is free to move relative to the elastic member except where it is attached to the fabric at the slit 42. There is sufficient movement to completely smooth the fabric about the container. The top edge portion 18 and the sidewall 32 of the tube contain aligned slits 44, 46 that are aligned with the top hem slit 42 to form a single continuous slit to thereby open the tube to facilitate fitting the tube about the container.

The single continuous slit if preferably fitted with an invisible zipper 48 that closes the slit after the cover is installed. A hook and eye fastener 50 is attached to the left and right hem end portions to securely close the slit when the tube is fitted about the container.

Operation of the present invention is believed to be apparent from the foregoing description and drawings, but a few words will be added for emphasis. The decorative cover is installed by opening the zipper, pulling the cover up over the base of the container, pulling the cover up over the lip on the top end portion of the container, and closing the zipper. Closing the hook and eye fastener prevents the zipper from intentionally opening. The final installation step is smoothing the fabric to eliminate any gathers or wrinkles.

It can now be appreciated that a decorative cover for a plant container contains a rectangular piece of fabric formed into an open tube for fitting about the container with the tube having a bottom edge portion defining a bottom opening, a top edge portion defining a top opening and a sidewall extending between the top and bottom edge portions wherein the top opening is concentric with the plant receiving opening of the container. A top hem is formed along the top edge portion about the top opening. A first elastic member is positioned in the top hem to contractibly expand the top opening with the top opening expanding to receive the container then retracting to fit the tube sidewall along the container sidewall. Similarly, a bottom hem is formed along the bottom edge portion about the bottom opening. A second elastic member is positioned in the bottom hem to contractibly expand the bottom opening with the bottom opening being expandable to receive the container and then retractable to fit the tube sidewall along the container sidewall. To better fit tapered and contoured container, the second elastic member draws the bottom opening smaller than the top opening so that the tube tapers.

The decorative cover, referred to as pot pants, are made to conform to the configuration of the planter it is installed upon. Each application is unique because the cover conforms to the container. The process of dressing a planter with pot pants is very simple like putting on a pair of pants. Simply slide the pot pants on the bottom of the container and pull them up over the top lip of the container, fasten the hook, and close the zipper. An ordinary plant container is instantly transformed into a decorative home or office accent.

While the invention has been described with particular reference to the preferred embodiments, it will be understood by those skilled in the art that various changes may be made and equivalents may be substituted for elements of the preferred embodiments without departing from invention. For example, the zipper could be eliminated to save material costs and labor as desired and the slit closed by sliding the fabric to minimize the slit. In addition, many modifications may be made to adapt a particular situation and material to a teaching of the invention without departing from the essential teachings of the present invention. For example, while it is preferred that the tube be constructed from a rectangular piece of fabric, the fabric could be trapezoidal to form a tapered tube or of other configuration to provide a contoured tube to fit a particular container. As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A decorative cover for a plant container, said container having a base with a sidewall extending upward from said base forming a top edge portion defining a plant receiving opening, said cover comprising:

a fabric formed into an open tube for fitting about said container, said tube having a bottom edge portion defining a bottom opening, a top edge portion defining a top opening and a sidewall extending between said top and bottom edge portions, said top opening being substantially the same dimension as said plant receiving opening of said container so that the fabric does not extend into the plant receiving opening and does not extend above said top edge portion;

a top hem formed along said top edge portion about said top opening;

first means, associated with said top hem, for contractibly expanding said top opening, said top opening and said tube sidewall expanding to receive said container, said tube sidewall then retracting to fit said tube sidewall along said container sidewall with said first means extending over said top edge portion toward said plant opening;

a bottom hem formed along said bottom edge portion about said bottom opening; and second means, associated with said bottom hem, for contractibly expanding said bottom opening, said bottom opening being expandable to receive said container and then retracting to fit said tube sidewall along said container sidewall with said bottom hem under said base.

2. A cover, as set forth in claim 1, wherein said fabric is a stretchy material capable of stretching both vertically and horizontally to fit about said container.

3. A cover, as set forth in claim 1, wherein said means for contractibly expanding said bottom opening includes an elastic member positioned in said bottom hem.

4. A cover, as set forth in claim 3, wherein said elastic member is free of attachment to said fabric so that said fabric is freely movable to eliminate wrinkles, folds and creases.

5. A cover, as set forth in claim 1, wherein said means for contractibly expanding said top opening includes an elastic member positioned in said top hem.

6. A cover, as set forth in claim 5, wherein said elastic member is free of attachment to said fabric so that said fabric is freely movable to eliminate wrinkles, folds and creases.

7. A cover, as set forth in claim 5, wherein said top hem contains a slit adjacent left and right hem end portions and wherein said elastic member has a left end attached to said left hem end portion and a right end attached to said right hem end portion.

8. A cover, as set forth in claim 7, wherein said top edge portion and said sidewall of said tube contain aligned slits that are aligned with said top hem slit to thereby open said tube to facilitate fitting said tube about said container.

9. A cover, as set forth in claim 8, wherein said aligned slits are fitted with a zipper.

10. A cover, as set forth in claim 7, including a hook and eye fastener attached to said left and right hem end portions to securely close said slit when said tube is fitted about said container.

11. A cover, as set forth in claim 1, wherein said bottom opening is drawn smaller than said top opening by said second means for contractibly expanding said bottom opening.

12. A decorative cover for a plant container, said container having a base with a sidewall extending upward from said base forming a top edge portion defining a plant receiving opening, said cover comprising:

a rectangular piece of fabric formed into an open tube for fitting about said container, said tube having a bottom edge portion defining a bottom opening, a top edge portion defining a top opening and a sidewall extending between said top and bottom edge portions, said top opening being concentric with and substantially the same dimension as said plant receiving opening of said container so that the fabric does not extend above or over said plant receiving opening;

a top hem formed along said top edge portion about said top opening;

a first elastic member positioned in said top hem for contractibly expanding said top opening, said top opening expanding to receive said container then retracting to fit said tube sidewall along said container sidewall;

a bottom hem formed along said bottom edge portion about said bottom opening; and a second elastic member positioned in said bottom hem for contractibly expanding said bottom opening, said bottom opening expanding to receive said container and then retracting to fit said tube sidewall along said container sidewall, said second elastic member drawing said bottom opening smaller than said top opening so that said tube sidewall tapers to more closely fit about said container.

13. A cover, as set forth in claim 12, wherein said elastic members are free of attachment to said fabric so that said fabric is freely movable to eliminate wrinkles, folds and creases.

14. A cover, as set forth in claim 12, wherein said fabric is a stretchy material capable of stretching both vertically and horizontally to fit about said container.

15. A cover, as set forth in claim 12, wherein said top hem contains a slit adjacent left and right hem end portions and wherein said first elastic member has a left end attached to said left hem end portion and a right end attached to said right hem end portion.

16. A cover, as set forth in claim 15, wherein said top edge portion and said sidewall of said tube contain aligned slits that are aligned with said top hem slit to thereby open said tube to facilitate fitting said tube about said container.

17. A cover, as set forth in claim 16, wherein said aligned slits are fitted with a zipper.

18. A cover, as set forth in claim 15, including a hook and eye fastener attached to said left and right hem end portions to securely close said slit when said tube is fitted about said container.

19. A decorative cover for a plant container, said container having a base with a sidewall extending upward from said base forming a top edge portion with a lip defining a plant receiving opening, said cover comprising:

a rectangular piece of fabric formed into an open tube for fitting about said container, said tube having a bottom edge portion defining a bottom opening, a top edge portion defining a top opening and a sidewall extending between said top and bottom edge portions, said top opening being substantially the same dimension as said plant receiving opening of said container with the fabric laying on and overlaying the lip without extending substantially beyond the lip into the plant receiving opening so that said fabric does not interfere with the plant receiving opening;

a top hem formed along said top edge portion about said top opening;

a first elastic member positioned in said top hem for contractibly expanding said top opening, said top opening expanding to receive said container then retracting to fit said tube sidewall along said container sidewall;

a bottom hem formed along said bottom edge portion about said bottom opening; and a second elastic member positioned in said bottom hem for contractibly expanding said bottom opening, said bottom opening being expandable to receive said container and then retractable to fit said tube sidewall along said container sidewall, said second elastic member drawing said bottom opening smaller than said top opening so that said tube sidewall tapers to more closely fit about said container.

20. A cover, as set forth in claim 19, including;

a first slit in said top hem adjacent left and right hem end portions, said elastic member having a left end attached to said left hem end portion and a right end attached to said right hem end portion;

a second slit in said top edge portion;

a third slit in said sidewall of said tube, said first, second and third slits being aligned and continuous to thereby open said tube to facilitate fitting said tube about said container;

a zipper in said aligned slits; and a hook and eye fastener attached to said left and right hem end portions to securely close said slit when said tube is fitted about said container.

* * * * *